US005441921A

United States Patent [19]

Verdonck et al.

[11] Patent Number: 5,441,921

[45] Date of Patent: Aug. 15, 1995

[54] IMAGE RECEIVING ELEMENT FOR THERMAL DYE DIFFUSION TRANSFER

[75] Inventors: Emiel Verdonck, Berlaar; Wilhelmus Janssens, Aarschot; Geert Defieuw, Kessel-Lo, all of Belgium

[73] Assignee: AGFA-GEVAERT, N.V., Mortsel, Belgium

[21] Appl. No.: 253,351

[22] Filed: Jun. 3, 1994

[30] Foreign Application Priority Data

Jun. 21, 1993 [EP] European Pat. Off. ..... 93201778

[51] Int. Cl.[6] ..... B41M 5/035; B41M 5/38

[52] U.S. Cl. ..... 503/227; 428/195; 428/423.1; 428/447; 428/500; 428/520; 428/522; 428/913; 428/914

[58] Field of Search ..... 8/471; 428/195, 423.1, 428/447, 500, 520, 522, 913, 914; 503/227

[56] References Cited

U.S. PATENT DOCUMENTS 5,330,962 7/1994 DeBrabandeve et al. ..... 503/227

*Primary Examiner*—B. Hamilton Hess

*Attorney, Agent, or Firm*—Breiner & Breiner

[57] ABSTRACT

The present invention provides an image receiving material containing on a support an image receiving layer having as a principal component the hardened product of (i) a vinylchloride-based resin containing active hydrogens, (ii) an aliphatic polyisocyanate having 3 isocyanate groups as specified in the claims and (iii) a polydialkylsiloxane containing active hydrogens. The present invention further relates to a method for making an image receiving element and to a method for obtaining images therewith.

6 Claims, No Drawings

IMAGE RECEIVING ELEMENT FOR THERMAL DYE DIFFUSION TRANSFER

DESCRIPTION

1. Field of the Invention

The present invention relates to receiving elements for use according to thermal dye sublimation transfer.

2. Background of the Invention

Thermal dye transfer methods include thermal dye sublimation transfer also called thermal dye diffusion transfer. This is a recording method in which a dye-donor element provided with a dye layer containing sublimating dyes having heat transferability is brought into contact with a receiver sheet and selectively, in accordance with a pattern information signal, heated with a thermal printing head provided with a plurality of juxtaposed heat-generating resistors, whereby dye is transferred from the selectively heated regions of the dye-donor element to the receiver sheet and forms a pattern thereon, the shape and density of which is in accordance with the pattern and intensity of heat applied to the dye-donor element.

The dye-image receiving element for use according to dye sublimation transfer usually comprises a support, e.g. paper or a transparent film, coated with a dye-image receiving layer, into which the dye can diffuse more readily. An adhesive layer may be provided between the support and the receiving layer. Means for improving the releasability of the receiving element from the donor element after transfer is effected are normally provided in the very receiving layer or on the top of it, a separate release layer may be coated.

As resins constituting the dye-image receiving layer there are known various thermoplastic vinylcopolymers having glass transition temperatures in the range of 50° C. to 100° C. such as copolymers of vinylchloride and vinylacetate, aromatic polyesters and styrene-acrylonitrile acrylates.

Receiving elements for use in thermal dye diffusion transfer have been described in e.g. EP 133012, EP 394460, U.S. Pat. No. 4,985,397, EP 543441 and WO 93/07002.

The dye layer of a dye donor element can be a monochrome dye layer or it may comprise sequential repeating areas of different coloured dyes like e.g. of cyan, magenta, yellow or optionally black hue. When a dye-donor element containing three or more primary colour dyes is used, a multicolour image can be obtained by sequentially performing the dye transfer process steps for each colour.

One of the possible applications of thermal dye sublimation transfer printing is the production of hard copies of medical diagnostic images. Although such a hard copy can be produced on a reflective support such as paper, in most applications hard copies are produced on transparencies. These hard copies can be monochrome, in particular monochrome black, or multicoloured.

The requirements for medical diagnostic images are very stringent e.g. it is required that the images have a high light stability, optical densities above 2 are required, besides a high degree of consistency of the obtained optical densities, when ageing the material on the shelf, and low sensitivity to finger prints.

U.S. Pat. No. 4,985,397 discloses an image receiving layer containing as the principal constituents a polyvinylchloride having active hydrogens and an isocyanate. Although high optical densities and sufficient light stability can be reached with such receiving layers, ageing tests of the image receiving material have shown that the reproducibility of the obtained optical densities is poor.

EP-A-503439 discloses a polyurethane based image-receiving layer obtained by reaction curing of e.g. a polyvinylchloride containing active hydrogens and a polyisocyanate, e.g. an aliphatic polyisocyanate. The image receiving layer may further comprise a silicone releasing agent. Although a high optical density and good stability of the density with time can be obtained, the proposed image receiving material appears to be highly susceptible to finger prints and releasibility from the donor element is not always satisfactory.

EP 440 227 discloses an image receiving material having on a support an image receiving layer containing a thermosetting composition of a polyvinylchloride resin having an active hydrogen, a silicon resin, a silicone oil that may have an active hydrogen and an aliphatic diisocyanate. Dye images obtained on such material are however susceptible of density changes when the material is aged for some time.

3. Summary of the Invention

It is an object of the present invention to provide an improved image receiving material for thermal dye transfer, in particular an image receiving material yielding high transferred dye densities with improved light stability of the transferred colour dyes, less susceptible to finger prints, that has a good releasibility and with an improved reproducibility of the density of the image when the image receiving material is stored for some time.

It is another object of the present invention to provide an image receiving material suitable for yielding images in a thermal dye transfer method that can be used for medical diagnostic purposes.

Further objects of the present invention will become clear from the description hereinafter.

According to the present invention there is provided a method for making an image receiving material comprising the steps of:

coating on a support a solution containing:

an organic solvent;

a vinylchloride-based resin containing active hydrogens;

an aliphatic polyisocyanate corresponding to the following formula (I):

$$\begin{array}{l} \qquad\qquad\qquad\quad CONH-(CH_2)_n-N=C=O \\ O=C=N-(CH_2)_n-N \\ \qquad\qquad\qquad\quad CONH-(CH_2)_n-N=C=O \end{array} \qquad (I)$$

wherein n represents an integer from 2 to 12;

a polydialkylsiloxane containing active hydrogens;

a catalyst for an isocyanate curing;

allowing for said coating to dry and cure to a conversion degree of at least 50%.

According to the present invention there is provided an image receiving material containing on a support an image receiving layer having as a principal component the hardened product of (i) a vinylchloride-based resin containing active hydrogens, (ii) an aliphatic polyisocyanate according to formula (I) and (iii) a polydialkylsiloxane containing active hydrogens.

According to the present invention there is also provided a method for obtaining images using an image receiving material as defined above in conjunction with a dye donor element comprising on a support a dye layer containing one or more thermally transferable dyes in a thermal dye transfer recording process. The obtained images are suitable for the purpose of medical diagnostics.

4. Detailed Description of the Invention

Aliphatic polyisocyanates for use in connection with the present invention correspond to the following formula (I):

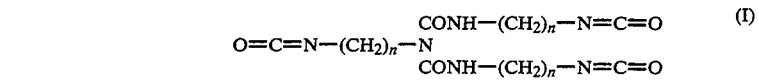

$$O{=}C{=}N{-}(CH_2)_n{-}N\begin{matrix}CONH{-}(CH_2)_n{-}N{=}C{=}O\\ CONH{-}(CH_2)_n{-}N{=}C{=}O\end{matrix} \quad (I)$$

wherein n represents an integer from 2 to 12.

A preferred isocyanate compound for use in the present invention according to the general formula I is the hexamethylene biuret polyisocyanate compound (n=6).

Examples of a vinylchloride-based resin containing active hydrogens for use in the present invention include vinylchloride-vinylacetate copolymers that are at least partially hydrolysed or copolymers of vinylchloride, vinylacetate and a hydroxyalkylacrylate.

Suitable polydialkylsiloxanes having active hydrogens for use in connection with the present invention are e.g. amino or hydroxy modified polydialkylsiloxanes such as e.g. a hydroxy-modified polydimethylsiloxane.

To increase the rate of the isocyanate curing reaction, catalysts are added to the coating solution for the image receiving layer. Suitable catalyst are e.g. organometallic compounds, e.g. compounds based on dibutyltin or dioctyltin e.g. dibutyltindilaurate or dioctyltindilaurate, or other organometallic compounds which include stannous octanoate, lead octanoate, zinc octanoate and cobalt naphtenate.

It is preferred that the vinyl chloride-based resin and polydialkylsiloxane both containing active hydrogen and an isocyanate compound according to formula (I) be employed in such an amount ratio that the molar ratio of the NCO groups in the isocyanate compound to the active hydrogen containing groups is 0.2 to 2.

The polydialkylsiloxane having active hydrogens, which can be hardened together with the vinylchloride based resin having active hydrogens by means of an isocyanate compound according to formula (I), is preferably incorporated in a ratio of 10 wt. % or less of the total weight of the vinyl chloride-based resin containing active hydrogens.

For the purpose of improving the whiteness of the receiving layer to enhance sharpness of the transferred image and also imparting writability to the receiving surface as well as preventing retransfer of the transferred image, a white pigment can be added to the receiving layer. As white pigment, titanium oxide, zinc oxide, kaolin, clay, calcium carbonate, fine powdery silica, etc. can be employed, and these can be used as a mixture of two or more kinds as described above.

Also, for further enhancing the light resistance of the transferred image, one or two or more kinds of additives such as UV-ray absorbers, light stabilizers and antioxidants, can be added, if necessary. The amounts of these UV-ray absorbers and light stabilizers is preferably 0.05 to 10 parts by weight and 0.5 to 3 parts by weight, respectively, per 100 parts of the resin constituting the receiving layer.

As the support for the receiver sheet it is possible to use a transparent film or sheet of various plastics such as polyethylene terephthalate, polyolefin, polyvinyl chloride, polystyrene, polycarbonate, polyether sulfone, polyimide, cellulose ester or polyvinyl alcohol-co-acetal. Blue-colored polyethylene terephthalate film can also be used. The support may also be a reflective support such as paper e.g. top quality paper, art paper, cellulose fiber paper; baryta-coated paper; polyolefin-coated paper e.g. dual polyethylene-coated paper; synthetic paper e.g. polyolefin type, polystyrene type or white polyester type i.e. white-pigmented polyester.

Also, a laminated product by any desired combination of the above can be used. Typical examples of the laminates include a laminate of cellulose fiber paper and synthetic paper and a laminate of cellulose fiber paper and a plastic film or sheet. As further examples of the laminates, a plastic film can be used with synthetic paper instead of cellulose fiber paper. Further, a laminate of cellulose fiber paper, plastic film and synthetic paper can also be used.

The support sheet serves to support the dye receiving layer, and it is desirable that the support sheet has mechanical strength sufficient enough to handle the dye receiving sheet which is heated at the time of heat transfer recording. If the dye-receiving layer alone has the necessary mechanical strength, the support sheet may be omitted.

The dye-receiving layer of the present invention preferably has an overall thickness of from 0.5 to 50 μm, more preferably from 2.5 to 10 μm, when the dye-receiving layer is provided on a support sheet, or preferably from 3 to 120 μm when it is self-supporting i.e. a support sheet is omitted.

The image receiving layer may be a single layer, or two or more such layers may be provided on the support.

Also receiving layers may be formed on both surfaces of the support. In the case of a transparent support recto-verso printing on both receiving layers as described in EP 452566 then leads to an increase in density of the transferred image.

In case a toplayer is provided the thickness of such a toplayer is preferably 0.01 to 5 μm, particularly 0.05 to 2 μm.

The image receiving element of the present invention may also have one or more intermediate layers between the support and the image receiving layer. Depending on the material from which they are formed, the intermediate layers may function as cushioning layers, porous layers or dye diffusion preventing layers, or may fulfill two or more of these functions, and they may also serve the purpose of an adhesive, depending on the particular application.

The material constituting the intermediate layer may include, for example, an urethane resin, an acrylic resin, an ethylenic resin, a butadiene rubber, or an epoxy resin. The thickness of the intermediate layer is preferably from 1 to 20 μm.

Dye diffusion preventing layers are layers which prevent the dye from diffusing into the support (particularly if the support is polyethylene-coated paper). The binders used to form these layers may be water soluble or organic solvent soluble, but the use of water soluble binders is preferred, and especially gelatin is most desirable.

Porous layers are layers which prevent the heat which is applied at the time of thermal transfer from diffusing from the image receiving layer to the support to ensure that the heat which has been applied is used efficiently.

Fine powders consisting of silica, clay, talc, diatomaceous earth, calcium carbonate, calcium sulfate, barium sulfate, aluminum silicate, synthetic zeolites, zinc oxide, lithophone, titanium oxide or alumina for example, can be included in the image receiving layers, cushioning layers, porous layers, diffusion preventing layers and adhesive layers, etc. constituting the thermal transfer image receiving element of the present invention.

Also, the image receiving element of the present invention can have antistatic treatment applied to the front or back surface thereof. Such antistatic treatment may be carried out by incorporating an antistatic agent in, for example, the image receiving layer which becomes the front surface or in an antistatic preventive layer applied to the image receiving surface. A similar treatment can also be effected to the back surface. By such treatment, mutual sliding between the image receiving sheets can be smoothly performed, and there is also the effect of preventing the attachment of dust on the image receiving sheet.

Furthermore, the image receiving sheet can have a lubricating layer provided on the back surface of the sheet support. The material for the lubricating layer may include methacrylate resins such as methyl methacrylate, etc. or corresponding acrylate resins, vinyl resins such as vinyl chloride-vinyl acetate copolymer.

The receiving element can have detection marks provided on one surface, preferably the back surface so that the receiving element can be accurately set at a desired position during transfer, whereby the image can be formed always at a correct desired position.

A dye-donor element for use according to thermal dye sublimation transfer in combination with the present receiving element usually comprises a very thin support e.g. a polyester support, one side of which is covered with a dye layer, which contains the printing dyes. Usually an adhesive or subbing layer is provided between the support and the dye layer. Normally the opposite side is covered with a slipping layer that provides a lubricated surface against which the thermal printing head can pass without suffering abrasion. An adhesive layer may be provided between the support and the slipping layer.

The dye layer can be a monochrome dye layer or it may comprise sequential repeating areas of different colored dyes like e.g. of cyan, magenta, yellow and optionally black hue. When a dye-donor element containing three or more primary color dyes is used, a multicolor image can be obtained by sequentially performing the dye transfer process steps for each color.

The dye layer of such a thermal dye sublimation transfer donor element is formed preferably by adding the dyes, the polymeric binder medium, and other optional components to a suitable solvent or solvent mixture, dissolving or dispersing the ingredients to form a coating composition that is applied to a support, which may have been provided first with an adhesive or subbing layer, and dried.

The dye layer thus formed has a thickness of about 0.2 to 5.0 μm, preferably 0.4 to 2.0 μm, and the ratio of dye to binder is between 9:1 and 1:3 by weight, preferably between 3:1 and 1:2 by weight.

As polymeric binder the following can be used: cellulose derivatives, such as ethyl cellulose, hydroxyethyl cellulose, ethylhydroxy cellulose, ethythydroxyethyl cellulose, hydroxypropyl cellulose, methyl cellulose, nitrocellulose, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably cellulose acetate butyrate or poly(styrene-acrylonitrile(-co-butadieen)) is used as binder for the dye layer.

Any dye can be used in such a dye layer provided it is easily transferable to the dye-image-receiving layer of the receiver sheet by the action of heat.

Typical and specific examples of dyes for use in thermal dye sublimation transfer have been described in, e.g., EP 453020, EP 209990, EP 209991, EP 216483, EP 218397, EP 227095, EP 227096, EP 229374, EP 235939, EP 247737, EP 257577, EP 257580, EP 258856, EP 279330, EP 279467, EP 285665, EP 400706, U.S. Pat. Nos. 4,743,582, 4,753,922, 4,753,923, 4,757,046, 4,769,360, 4,771,035, JP 84/78894, JP 84/78895, JP 84/78896, JP 84/227490, JP 84/227948, JP 85/27594, JP 85/30391, JP 85/229787, JP 85/229789, JP 85/229790, JP 85/229791, JP 85/229792, JP 85/229793, JP 85/229795, JP 86/41596, JP 86/268493, JP 86/268494, JP 86/268495 and JP 86/284489.

The coating layer may also contain other additives, such as curing agents, preservatives, organic or inorganic fine particles, dispersing agents, antistatic agents, defoaming agents, viscosity controlling agents, etc., these and other ingredients being described more fully in EP 133011, EP 133012, EP 111004and EP 279467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a polyethylene terephthalate support. In general, the support has a thickness of 2 to 30 μm. The support may also be coated with an adhesive or subbing layer, if desired.

The dye layer of the dye-donor element may be coated on the support or printed thereon by a printing technique such as a gravure process.

A dye-barrier layer comprising a hydrophilic polymer may also be employed in the dye-donor element between its support and the dye layer to improve the dye transfer densities by preventing wrong-way transfer of dye towards the support. The dye barrier layer may contain any hydrophilic material which is useful for the intended purpose. In general, good results have been obtained with gelatin, polyacryl amide, polyisopropyl acrylamide, butyl methacrylate grafted gelatin, ethyl methacrylate grafted gelatin, ethyl acrylate grafted gelatin, cellulose monoacetate, methyl cellulose, polyvinyl alcohol, polyethylene imine, polyacrylic acid, a mixture of polyvinyl alcohol and polyvinyl acetate, a mixture of polyvinyl alcohol and polyacrylic acid or a mixture of cellulose monoacetate and polyacrylic acid. Suitable dye barrier layers have been described in e.g. EP 227091 and EP 228065. Certain hydrophilic polymers, for example those described in EP 227091, also have an adequate adhesion to the support and the dye layer, thus eliminating the need for a separate adhesive or subbing layer. These particular hydrophilic polymers used in a single layer in the donor element thus perform a dual function, hence are referred to as dye-barrier/-subbing layers.

Preferably the reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable slipping layers are described in e.g. EP 138483, EP 227090, U.S. Pat. Nos. 4,567,113, 4,572,860, 4,717,711. Preferably the slipping layer comprises as binder a polycarbonate derived from 1,1-bis-(hydroxyphenyl)-3,3,5-trimethylcyclohexane. The dye layer of the dye-donor element may also contain a releasing agent that aids in separating the dye-donor element from the dye-receiving element after transfer. The releasing agents can also be applied in a separate layer on at least part of the dye layer. For the releasing agent solid waxes, fluorine- or phosphate-containing surfactants and silicone oils are used. Suitable releasing agents are described in e.g. EP 133012, JP 85/19138, EP 227092.

The dye-receiving elements according to the invention are used to form a dye transfer image. Such a process comprises placing the dye layer of the donor element in face-to-face relation with the dye-receiving layer of the receiver sheet and imagewise heating from the back of the donor element. The transfer of the dye is accomplished by heating for about several milliseconds at a temperature of 400° C.

When the process is performed for but one single color, a monochrome dye transfer image is obtained. A multicolor image can be obtained by using a donor element containing three or more primary color dyes and sequentially performing the process steps described above for each color. The above sandwich of donor element and receiver sheet is formed on three occasions during the time when heat is applied by the thermal printing head. After the first dye has been transferred, the elements are peeled apart. A second dye-donor element (or another area of the donor element with a different dye area) is then brought in register with the dye-receiving element and the process repeated. The third color and optionally further colors are obtained in the same manner.

In order to accomplish a perfect register when the process is performed for more than one color and in order to detect what color is existing at the printing portion of the donor element, detection marks are commonly provided on one surface of the donor element. Generally optically detectable marks are used that can be detected by a light source and a photo sensor; detection can be done by measuring the light transmitted through the detection mark or reflected from said mark. The marks being in the form of a light-absorbing or light-reflecting coating are formed in a preassigned position on the donor element by e.g. gravure printing. The detection marks can comprise an infrared absorbing compound such as carbon black. The detection mark can also comprise one of the image dyes that are used for the image formation, with the detection being in the visible range.

In addition to thermal heads, laser light, infrared flash or heated pens can be used as the heat source for supplying heat energy. Thermal printing heads that can be used to transfer dye from the dye-donor element to the receiver sheet are commercially available. In case laser light is used the dye layer or another layer of the dye element has to contain a compound that absorbs the light emitted by the laser and converts it into heat, e.g. carbon black.

Alternatively, the support of the dye-donor element may be an electrically resistive ribbon consisting of, for example, a multi-layer structure of a carbon loaded polycarbonate coated with a thin aluminum film. Current is injected into the resistive ribbon by electrically adressing a print head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology compared to the thermal head technology where the various elements of the thermal head get hot and must cool down before the head can move to the next printing position.

The following examples are provided to illustrate the invention in more detail without limiting, however, the scope thereof. All parts are by weight unless otherwise specified. In the examples the following isocyanate hardening agents are used:

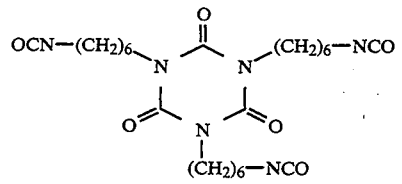

I1

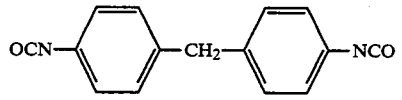

I2

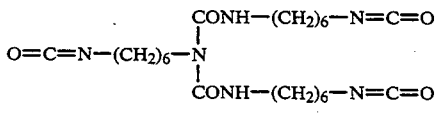

I3

The above isocyanate compounds were all supplied by Bayer.

EXAMPLE 1

Comparison between an aromatic and aliphatic polyisocyanate compound as a hardening agent.

Two receiving elements on a polyethylene terephthalate film support having a thickness of 175 μm with the following characteristics were used: both on a subbing layer containing after drying for 3 minutes at 120° C.: 3,6 g/m² of poly(vinylchloride/-covinylacetate/covinylalcohol) (Vinylite VAGD supplied by Union Carbide), 0,150 g/m² Tegomer HSI 2110-dihydroxypolydimethylsiloxane, supplied by Th.Goldschmidt AG. One of the receiving elements was hardened with an aromatic diisocyanate compound containing after drying 0,357 g/m² of I2 and 0,0143 g/m² of a zinc octanoate solution (Siccatol zn 12 from Akzo) as a catalyst.

The other was hardened with an aliphatic polyisocyanate compound containing after drying 1,16 g/m² of I1 and 0,046 g/m² of a zinc octanoate solution (Siccatol Zn 12 from Akzo) as a catalyst.

Dye-donor elements for use with the above described receiving elements according to thermal dye sublimation transfer were prepared as follows:

A solution in methyl ethyl ketone of 0,5% by weight of poly(styrene-co-acrylonitrile) (Luran 388S, supplied by BASF Germany) as a binder and a dye in the amount in % by weight as indicated in Table 1 was prepared.

A dye layer having a wet thickness of 100 μm was coated from this solution on a polyethylene terephthalate film support having a thickness of 6 μm and carrying a conventional subbing layer. The resulting dye layer was dried by evaporation of the solvent.

The opposite side of the film support was coated with a subbing layer of a copolyester comprising ethylene glycol, adipic acid, neopentyl glycol, therephthalic acid, isophthalic acid, and glycerol.

The resulting subbing layer was covered with a solution in methyl ethyl ketone of 0.5 g/m² of a polycarbonate having the following structural formula to form a heat-resistant layer:

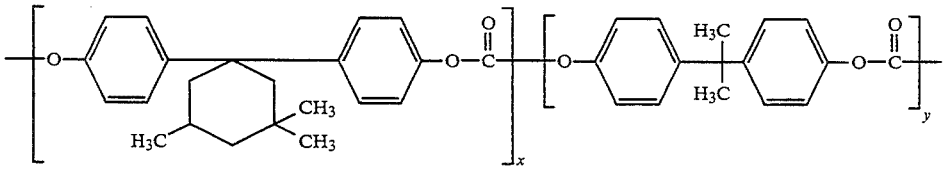

wherein x=55 mol % and y=45 mol %.

Finally, a top layer of polyether-modified polydimethylsiloxane (Tegoglide 410, Goldschmidt) was coated from a solution in isopropanol on the resulting heat-resistant polycarbonate layer.

The dye-donor element was printed in combination with the above described receiver sheets in a Mitsubishi colour video printer CP100E.

The receiver sheet was separated from the dye-donor element and the colour density value of the recorded image was measured by means of a Macbeth TR 924 densitometer in the red, green, and blue regions in Status A mode.

The above described experiment was repeated for each the dyes identified in Table 1 and 2 hereinafter.

Finally, each receiver sheet was subjected to irradiation by means of a xenon lamp of 150 klux for a time indicated in hours in Table 1 and the colour density values were measured again. The density change was calculated and is listed in percent in Table 1.

The chemical structure of the dyes used in the experiments is given in Table 2 hereinafter.

The results listed in Table 1 show that the light stabilities of the dyes, belonging to various structural classes, transferred on the receiver with the aliphatic isocyanate hardening agent are superior to those obtained on the receiver with the aromatic isocyanate hardening agent.

TABLE 1

| Dye Nr | % Dye by weight used | Density change in % after xenon exposure for: Desmodur VL aromatic 4 h | 12 h | 28 h | Desmodur N3300 aliphatic 4 h | 12 h | 28 h |
|---|---|---|---|---|---|---|---|
| 1 | 0.3 | −4 | −13 | −64 | 0 | −5 | −7 |
| 2 | 0.3 | −3 | −11 | −39 | −1 | −3 | −10 |
| 3 | 0.3 | −3 | −10 | −18 | −3 | −6 | −6 |
| 4 | 0.2 | −14 | −44 | −79 | −14 | −28 | −46 |
| 5 | 0.2 | −15 | −47 | −74 | −14 | −24 | −48 |
| 6 | 0.3 | −13 | −61 | −98 | −8 | −16 | −35 |
| 7 | 0.5 | 0 | −9 | −41 | −2 | −6 | −22 |
| 8 | 0.3 | −13 | −31 | −85 | −8 | −25 | −79 |
| 9 | 0.5 | −16 | −62 | −87 | −1 | −7 | −29 |
| 10 | 0.5 | −5 | −34 | −65 | −2 | −7 | −24 |

TABLE 2

Dye 1

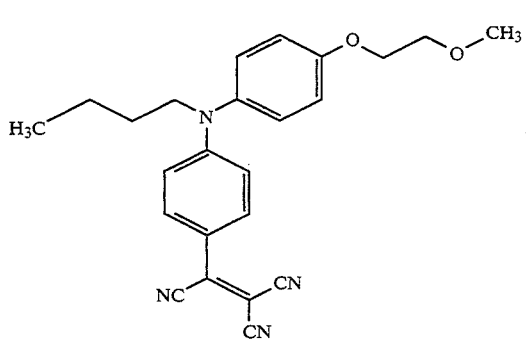

Dye 2

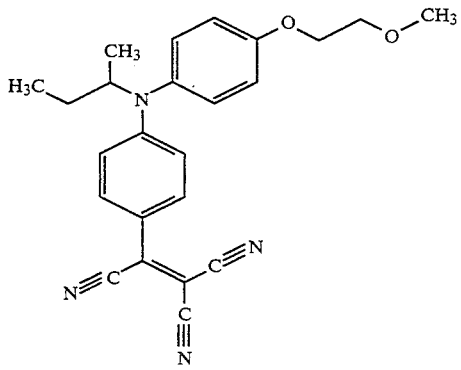

-continued

TABLE 2

Dye 3

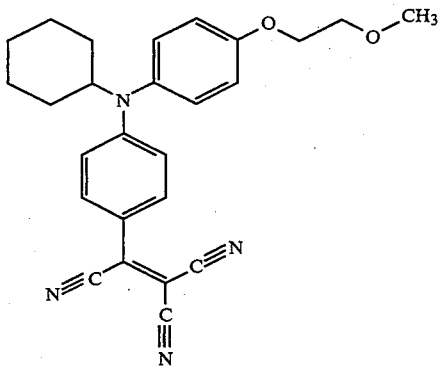

Dye 4

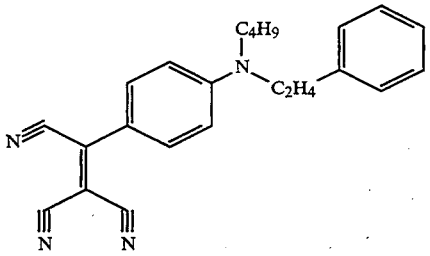

Dye 5

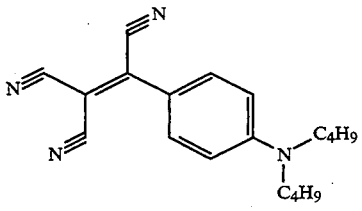

Dye 6

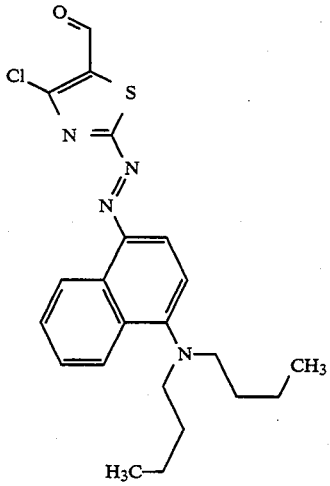

Dye 7

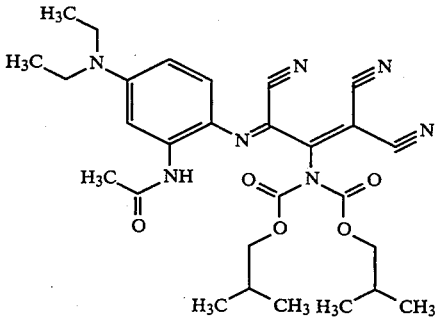

-continued

TABLE 2

Dye 8

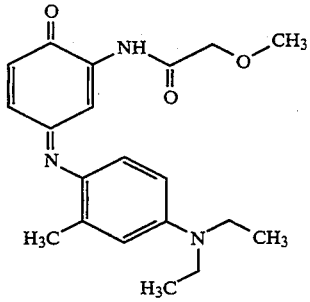

Dye 9

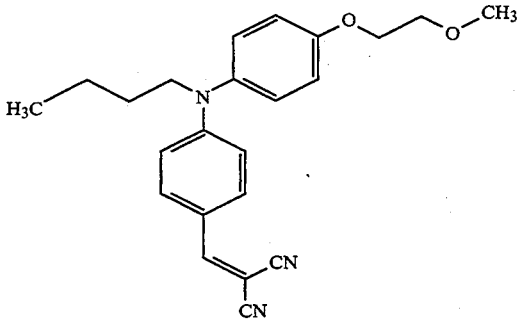

Dye 10

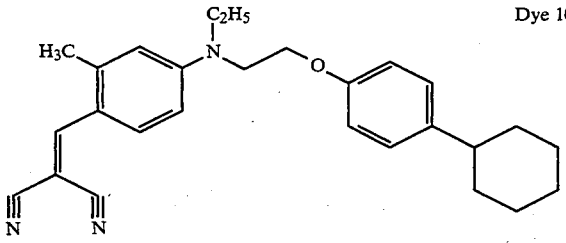

EXAMPLE 2

Comparison between hardening with an aliphatic triisocyanate compound not according to formula (I) and aliphatic triisocyanate compound according to formula (I).

Two receiving elements on a polyethylene terephthalate film support having a thickness of 175μ and two receiving elements on a white opaque polyethylene terephthalate film support having a thickness of 175μ have been prepared according to the following composition.

Receiver 1: Transparent film support, aliphatic triisocyanate (not according to formula (I)) hardening agent I1.

After drying for 3 minutes at 120° C., the transparent film support was containing:

3,6 g/m$^2$ of Vinylite VAGD 0,560 g/m$^2$ of I1

0,150 g/m$^2$ of the dihydroxypolydimethyl siloxane Tegomer HSI 2110.

The ratio of —NCO/—OH groups amounting to 1/2

0,022 g/m$^2$ of a zinc octanoate solution (Siccatol Zn 12 from akzo). Receiver 2: Transparent film support, aliphatic triisocyanate (according to formula (I)) hardening agent I3.

After drying for 3 minutes at 120° C., the transparent film support was containing:

3,6 g/m$^2$ of Vinylite VAGD 0,435 g/m$^2$ of I3

0,150 g/m² of the dihydroxypolydimethyl siloxane Tegomer HSI 2110.

The ratio of —NCO/—OH groups amounting to 1/2,3

0,017 g/m² of a zinc octanoate solution (Siccatol Zn 12 from Akzo).

Receiver 3: Opaque film support, aliphatic triisocyanate hardening agent I1.

After drying for 3 minutes at 120° C., the opaque film support was containing:

3,6 g/m² of Vinylite VAGD 0,997 g/m² of I1

0,300 g/m² of the dihydroxypolydimethyl siloxane Tegomer HSI 2110.

The ratio of —NCO/—OH groups amounting to 1/2

0,0016 g/m² of dibutyltindilaurate.

Receiver 4: Opaque film support, aliphatic triisocyanate hardening agent I3.

After drying for 3 minutes at 120° C., the opaque film support was containing:

3,6g/m² of Vinylite VAGD 0,290 g/m² of I3

0,150 g/m² of the dihydroxypolydimethyl siloxane Tegomer HSI 2110.

The ratio of —NCO/—OH groups amounting to 1/3,5

0,012 g/m² of a zinc octanoate solution (Siccatol Zn 12 from Akzo).

The four receiving elements were used as in example 1 in combination with a tri-coloured yellow, magenta, cyan gravure printed dye-donor element as described hereinafter. The transfer process has been repeated three times, once with freshly coated receiving elements, once after storing it for 6 days at 57° C./34% RH and once after storing it for 12 days at 57° C./34% RH.

The obtained results and variation in maximum densities can be seen in Table 3.

From this table it is clear that with the aliphatic triisocyanate compound not according to formula (I) the obtained maximum densities are decreased during storage of the receiving elements. With the triisocyanate compound according to formula (I) the obtained maximum densities remain virtually the same within the experimental error.

The maximum colour densities are obtained from a three colour donor element made by gravure printing on a Diafoil K200 6 μm of the following printing inks. The structure formulas of the colour dyes are given in Table 4.

Yellow colour ink containing a solution in methylethyl ketone:

10% by weight of the binder LURAN 388S, supplied by BASF

6% by weight of the yellow dye D1

6% by weight of the yellow dye D2

Magenta colour ink containing:

10% by weight of binder as for yellow colour ink

9% by weight of the magenta dye D3

2% by weight of the magenta dye D4

Cyan colour ink containing:

10% by weight of binder as for yellow colour ink

8% by weight of the cyan dye D5

4% by weight of the cyan dye D6

TABLE 3

| | Start | | | | After 6 days 57° C./34% RH | | | | After 12 days 57° C./34% RH | | | |
|---|---|---|---|---|---|---|---|---|---|---|---|---|
| | Y | M | Cy | Vis | Y | M | Cy | Vis | Y | M | Cy | Vis |
| Receiver 1 I1 | 238 | 217 | 161 | | 226 | 201 | 147 | | 223 | 196 | 135 | |
| Receiver 2 I3 | 234 | 209 | 149 | | 233 | 207 | 142 | | 229 | 205 | 131 | |
| Receiver 3 I1 | 244 | 264 | 184 | 220 | 215 | 213 | 137 | 192 | 208 | 208 | 144 | 183 |
| Receiver 4 I3 | 228 | 275 | 217 | 291 | 234 | 256 | 200 | 280 | 229 | 271 | 200 | 287 |

TABLE 4

D1 is dye 10 of table 2

D2 is dye 9 of table 2

D3 is dye 1 of table 2

D4

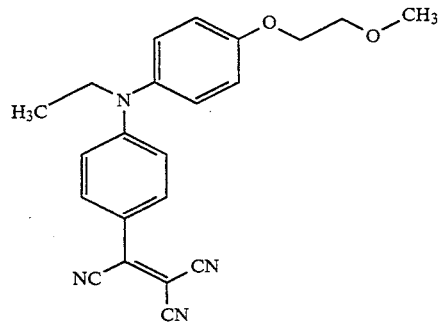

D5 is dye 7 of table 2

D6

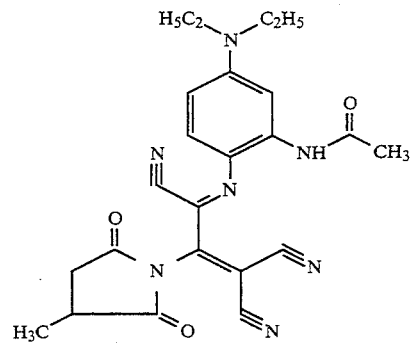

EXAMPLE 3

Comparison of the sensitivity to finger prints of a receiving element containing a polydialkylsiloxane releasing agent with active hydrogens and of a receiving element containing a silicon oil on top of it.

Two receiving elements on a polyethyelene terephthalate film support having a thickness of 175 μm with the following characteristics were coated:

Receiver A: The receiving layer after drying for 3 minutes at 120° C. contains:

3,6 g/m$^2$ of poly(vinylchloride/covinylacetate/-covinylalcohol) (Vinylite VAGD supplied by Union Carbide)

1,16 g/m$^2$ of I3

0,046 g/m$^2$ of a zinc octanoate solution (Siccatol Zn 12 from Akzo) as a catalyst On top of it was coated a solution of releasing agent in methyl ethyl ketone so that after drying for 3 minutes at 120° C. the layer contains:

0,140 g/m$^2$ of Tegoglide 410 supplied by Th. Goldschmidt AG.

Receiver B: The receiving layer after drying for 3 minutes at 120° C. contains:

3,6 g/m$^2$ of poly(vinylchloride/covinylacetate/-covinylalcohol) (Vinylite VAGD supplied by Union Carbide)

1,16 g/m$^2$ of I3

0,046 g/m$^2$ of a zinc octanoate solution (Siccatol Zn 12 from Akzo) as a catalyst 0,150 g/m$^2$ Tegomer HSI2110-dihydroxypolydimethylsiloxaan, supplied by Th.Goldschmidt AG.

Evaluation : Receiver A, upon manual handling showed clearly discernible finger prints. On Receiver B on the contrary hardly any finger print could be seen.

Receiver sheet no. 2 of example 2 was also evaluated on finger prints and it was found that hardly any finger prints could be detected after manual handling.

EXAMPLE 4

Comparison between two formulations for the receiving layer with and without a catalyst.

Two receiving elements on a polyethylene terephthalate film support having a thickness of 175$\mu$ have been prepared according to the following composition.

Receiver 1: Formulation with catalyst

After drying for 3 minutes at 120° C., the transparent film support was containing:

3,6 g/m$^2$ of Vinylite VAGD 0,435 g/m$^2$ of I3

0,150 g/m$^2$ of the dihydroxypolydimethyl siloxane Tegomer HSI 2110

The ratio of —NCO/—OH groups amounting to 1/2,3

0,017 g/m$^2$ of a zinc octanoate solution (Siccatol Zn 12 from Akzo)

Receiver 2: Formulation without hardening catalyst.

The same composition as for Receiver 1 but without catalyst.

Evaluation:

Receiver 1: No problems were found on the surfaces of the two media after thermal transfer and separation.

Receiver 2: The donor element sticked to the image receiving medium.

We claim:

1. An image receiving material containing on a support an image receiving layer having as a principal component the hardened product of (i) a vinylchloride-based resin containing active hydrogens, (ii) an aliphatic polyisocyanate according to formula (I) and (iii) a polydialkylsiloxane containing active hydrogens:

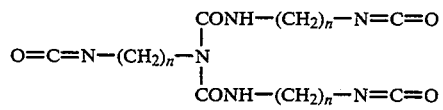

(I)

wherein n represents an integer from 2 to 12.

2. An image receiving material according to claim 1 wherein said vinylchloride based resin is a hydrolysed vinylchloride-vinylacetate copolymer.

3. An image receiving material according to claim 1 or 2 wherein said polydialkylsiloxane containing active hydrogens is a hydroxy modified polydimethylsiloxane.

4. A method for making an image according to the thermal sublimation transfer process comprising the steps of:

bringing a dye layer containing one or more thermally transferable dyes of a dye donor element into face-to-face contact with an image receiving layer contained on a support of an image receiving element, said image receiving layer having as a principal component the hardened product of (i) a vinylchloride-based resin containing active hydrogens, (ii) an aliphatic polyisocyanate according to formula (I) and (iii) a polydialkylsiloxane containing active hydrogens:

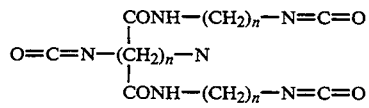

(I)

wherein n represents an integer from 2 to 12;

image-wise heating a thus obtained assemblage from the back of said dye donor element and separating said dye donor element from said image receiving element.

5. A method according to claim 1 wherein said vinylchloride based resin is a hydrolyzed vinylchloride-vinylacetate copolymer.

6. A method according to claim 1 wherein said polydialkylsiloxane containing active hydrogens is a hydroxy modified polydimethylsiloxane.

* * * * *